US008517173B2

(12) United States Patent
Gui et al.

(10) Patent No.: US 8,517,173 B2
(45) **Date of Patent: *Aug. 27, 2013**

(54) CASE FOR HOLDING A HAND TOOL

(75) Inventors: YaoKun Gui, Shanghai (CN); Brent Christopher, Portland, OR (US); Mark Holtan, Centennial, CO (US); Anthony Kriz, Lone Tree, CO (US)

(73) Assignee: Meridian International Co., Ltd. (CN)

( * ) Notice: Subject to any disclaimer, the term of this patent is extended or adjusted under 35 U.S.C. 154(b) by 188 days.

This patent is subject to a terminal disclaimer.

(21) Appl. No.: 13/285,611

(22) Filed: Oct. 31, 2011

(65) Prior Publication Data

US 2012/0043239 A1 Feb. 23, 2012

Related U.S. Application Data

(63) Continuation of application No. 12/605,600, filed on Oct. 26, 2009, now Pat. No. 8,079,469.

(30) Foreign Application Priority Data

Jul. 7, 2009 (CN) ..... 2009 2 0077910 U

(51) Int. Cl.
*B65D 85/00* (2006.01)

(52) U.S. Cl.
USPC ..... 206/349; 206/372

(58) Field of Classification Search
USPC ..... 206/349, 372, 373, 374, 376, 378, 206/379; 16/421, 429
See application file for complete search history.

(56) References Cited

U.S. PATENT DOCUMENTS

| | | | | |
|---|---|---|---|---|
| 1,177,072 | A * | 3/1916 | Warman | 294/57 |
| 1,800,254 | A * | 4/1931 | Holmes | 16/421 |
| 4,682,688 | A | 7/1987 | Budert | |
| 4,899,877 | A * | 2/1990 | Kiernan | 206/349 |
| 4,924,733 | A | 5/1990 | McKenzie | |
| 5,174,178 | A | 12/1992 | Distton, Jr. | |
| 5,279,417 | A * | 1/1994 | Seaton | 206/349 |
| 5,606,897 | A | 3/1997 | Quinn | |
| 5,740,706 | A | 4/1998 | Tseng | |

(Continued)

OTHER PUBLICATIONS

Gui, Yao Kun, U.S. Appl. No. 12/605,600, filed Oct. 26, 2009.

(Continued)

*Primary Examiner* — Steven A. Reynolds
*Assistant Examiner* — King M Chu
(74) *Attorney, Agent, or Firm* — Jason R. Sytsma; Shuttleworth & Ingersoll, PLC

(57) ABSTRACT

In accordance with one aspect of the present invention, a case for holding a hand tool at a point of sale is provided. The hand tool has a working end and a handle. The handle projects from the case to form a handle for the case and the case engages the hand tool such that the hand tool is prevented from being removed from the case while simultaneously, the handle can be rotated with respect to the case to test a function of the hand tool. Before the case and the hand tool is purchased the hand tool is prevented from being removed from the case; however, the handle can be rotated with respect to the case when the case is in a closed position. After the hand tool is purchased the customer can break a seal and the case may be opened, thereby allowing the tool to be removed from the case when the case is in an open position.

31 Claims, 3 Drawing Sheets

(56) References Cited

U.S. PATENT DOCUMENTS

| | | | | |
|---|---|---|---|---|
| 5,743,395 | A | 4/1998 | Backer | |
| 5,749,272 | A * | 5/1998 | Phan | 81/62 |
| 5,816,401 | A * | 10/1998 | Vasudeva et al. | 206/377 |
| 5,842,567 | A * | 12/1998 | Rowe et al. | 206/364 |
| 5,899,329 | A * | 5/1999 | Hu et al. | 206/376 |
| 5,918,741 | A * | 7/1999 | Vasudeva | 206/376 |
| 6,079,298 | A | 6/2000 | Gasperi et al. | |
| 6,164,463 | A * | 12/2000 | Lee | 211/70.6 |
| 6,237,451 | B1 | 5/2001 | Wei | |
| 6,425,482 | B1 * | 7/2002 | Chiang | 206/349 |
| 6,457,916 | B2 | 10/2002 | Wienhold | |
| 6,464,840 | B1 | 10/2002 | McCann | |
| 6,561,523 | B1 | 5/2003 | Weinhold | |
| 6,626,295 | B1 * | 9/2003 | Vasudeva | 206/373 |
| D483,180 | S * | 12/2003 | Chen | D3/282 |
| 6,685,018 | B1 * | 2/2004 | Chuan | 206/373 |
| 7,373,860 | B1 * | 5/2008 | Rinner | 81/177.1 |
| 8,079,469 | B2 * | 12/2011 | Gui et al. | 206/349 |
| 2002/0020537 | A1 * | 2/2002 | Shonfeld et al. | 172/378 |
| 2002/0027092 | A1 | 3/2002 | Hu | |
| 2004/0094444 | A1 | 5/2004 | Chen | |
| 2004/0251153 | A1 * | 12/2004 | Chen | 206/375 |
| 2005/0189250 | A1 | 9/2005 | Hsu | |
| 2005/0247587 | A1 * | 11/2005 | Holland-Letz | 206/373 |
| 2006/0260964 | A1 * | 11/2006 | Feldmann et al. | 206/373 |
| 2007/0023307 | A1 | 2/2007 | Liu | |
| 2007/0095690 | A1 | 5/2007 | Nguy et al. | |
| 2007/0163906 | A1 * | 7/2007 | Crain et al. | 206/361 |
| 2007/0214916 | A1 * | 9/2007 | Lee | 81/177.1 |
| 2007/0228240 | A1 | 10/2007 | Kao | |
| 2008/0083304 | A1 * | 4/2008 | Finn | 81/177.4 |
| 2008/0110302 | A1 | 5/2008 | Liu | |
| 2009/0236250 | A1 | 9/2009 | Wang | |
| 2009/0242443 | A1 | 10/2009 | Chen | |
| 2010/0108552 | A1 | 5/2010 | Scrimshaw et al. | |

OTHER PUBLICATIONS

Christopher, Brent, U.S. Appl. No. 12/789,141, filed May 27, 2010.
Christopher, Brent, U.S. Appl. No. 12/789,158, filed May 27, 2010.
Christopher, Brent, U.S. Appl. No. 29/362,607, filed May 27, 2010.
Christopher, Brent, U.S. Appl. No. 29/384,782, filed Feb. 3, 2011.
Christopher, Brent, U.S. Appl. No. 29/397,848, filed Jul. 21, 2011.
Jul. 9, 2010 USPTO Office Action from related U.S. Appl. No. 12/605,600.
European Search Report dated Oct. 25, 2010 from counterpart European application.
Oct. 28, 2010 USPTO Office Action from related U.S. Appl. No. 12/789,158.
Apr. 18, 2011 USPTO Office Action from related U.S. Appl. No. 12/789,158.
Mar. 31, 2011 USPTO Office Action from related U.S. Appl. No. 12/605,600.
Jul. 21, 2011 USPTO Office Action from related U.S. Appl. No. 12/605,600.
Definition of ratchet from the Merriam-Webster Online Dictionary. http://www.merriam-webster.com/dictionary/ratchet. Accessed Jul. 13, 2011.

* cited by examiner

CASE FOR HOLDING A HAND TOOL

CROSS-REFERENCE TO RELATED APPLICATIONS

This application is a continuation of U.S. patent application Ser. No. 12/605,600 filed Oct. 26, 2009, which claims the benefit of Chinese Application 200920077910.4 filed Jul. 7, 2009, the contents of both are incorporated herein by reference.

TECHNICAL FIELD

This invention relates to a case for displaying hand tools at a point of sale, and particularly a case that allows a customer to test the hand tool without removing the hand tool from the case.

BACKGROUND INFORMATION

Tool sets are customarily sold in cases with multiple interchangeably driven bits. The cases are sealed at the point of sale to prevent the hand tool and/or the driven bits from being lost or stolen. Consequently, it is not possible for the customer to test the hand tool without opening the case and breaking the seal.

Previous disposable packages have been designed to allow the customer to test a tool while it remains in the package. Such packaging has been limited to scissor type hand tools wherein one handle is exposed and the other loop handle is enclosed in the packaging. The packaging has some room for the working end of the scissors to operate.

Heretofore, reusable cases have not been designed so a hand tool can be functionally tested while remaining in the case. Accordingly, there is a need for a case that provides for functional testing of the handle by the user, while securing the tool to the case.

SUMMARY

In accordance with one aspect of the present invention, a case for holding a hand tool at a point of sale is provided. The hand tool has a working end and a handle. The handle projects from the case to form a handle for the case and the case engages the hand tool such that the hand tool is prevented from being removed from the case, while simultaneously the handle can be rotated with respect to the case to test a function of the hand tool. Before the case and the hand tool is purchased the hand tool is prevented from being removed from the case, but the handle can be rotated with respect to the case. After the hand tool is purchased the customer can break a seal and the case may be opened, thereby allowing the tool to be removed from the case.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
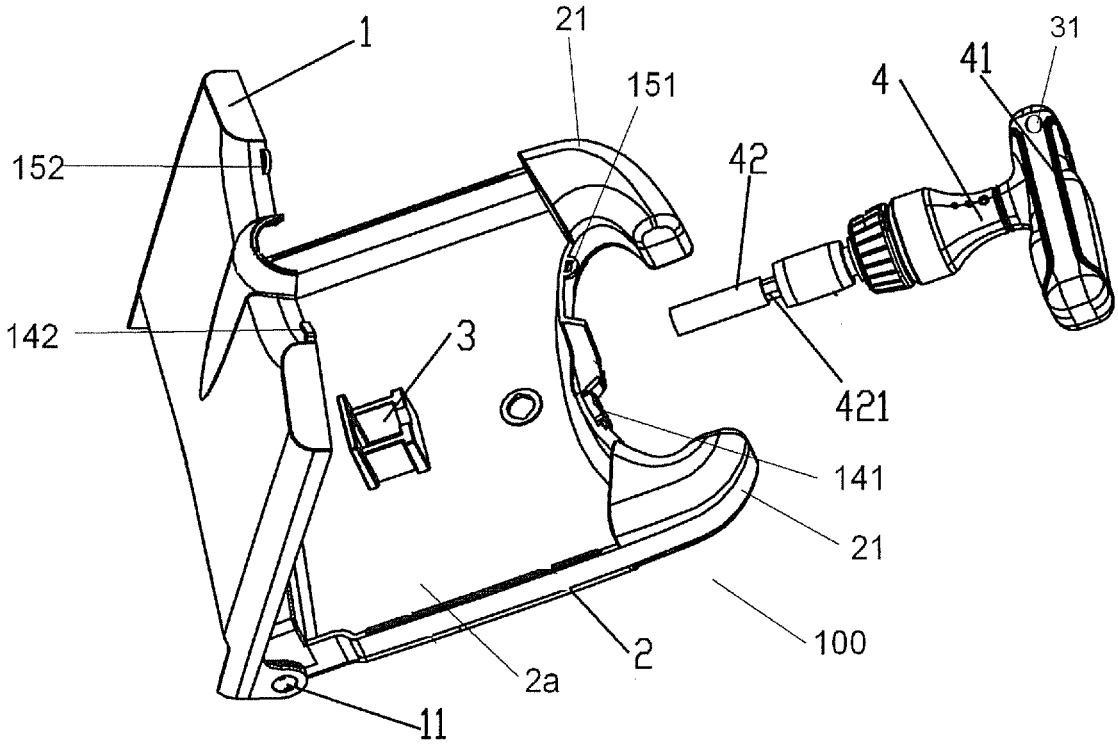
FIG. 1 is a perspective view of the front side of the tool case in the open position and the tool removed from the tool case.
Figure 2:
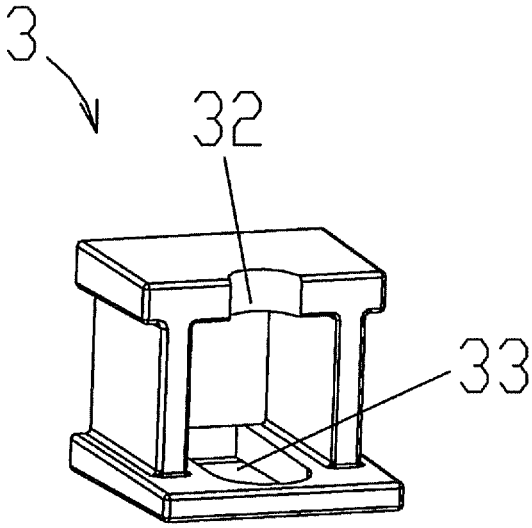
FIG. 2 is a perspective view of the retaining member of the tool case.
Figure 3:
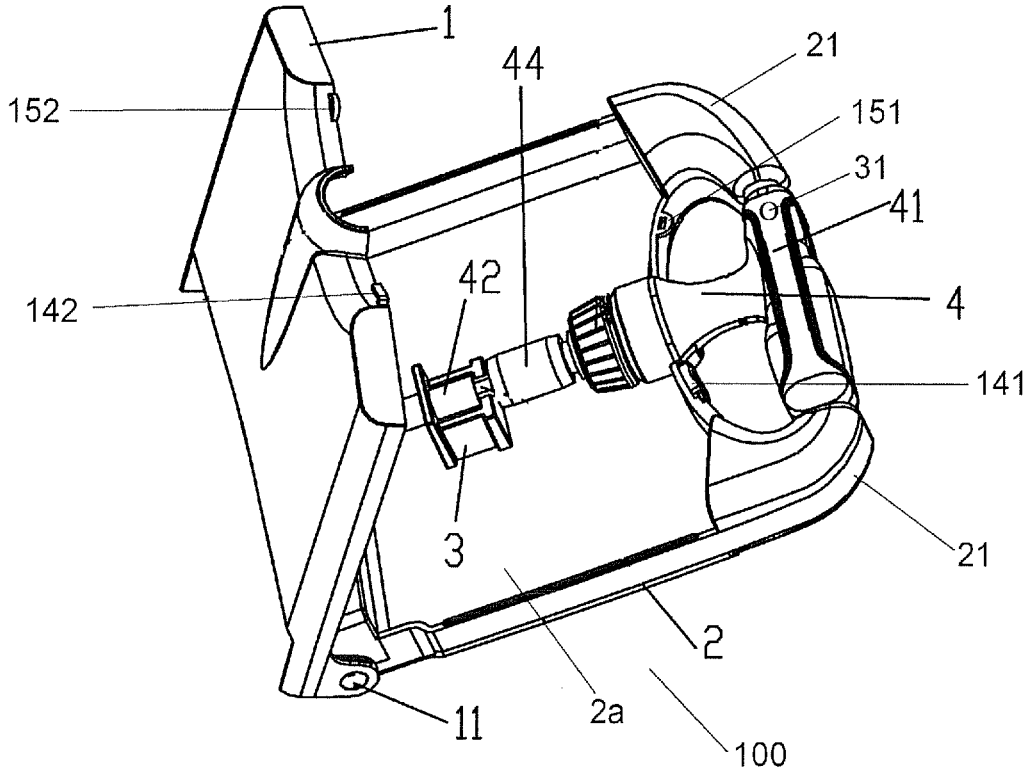
FIG. 3 is a perspective view of the front side of the tool case in the open position with the tool combined with the tool case.
Figure 4:
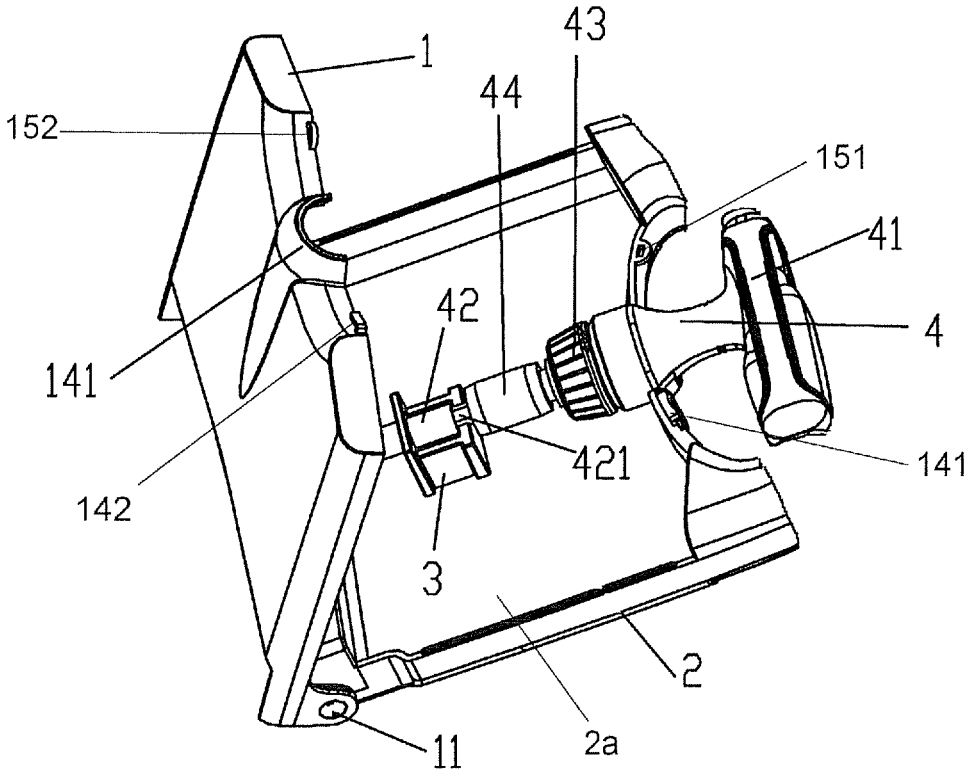
FIG. 4 is a perspective view of the front side of the tool case with the tool combined with the case of a second embodiment.

With reference to FIGS. 1-4, the hand tool 4, in accordance with an embodiment, is a ratcheting type driver 4; however, one skilled in the art would understand that the present disclosure is not so limited. The driver 4 has a working end 42 and a handle 41. The handle 41 projects from the case 100 to form a handle 41 for the case 100 and the working end 42 is attached inside the case 100 by a retaining member 3, to prevent the hand tool 4 from being removed.

The case 100 in accordance with an embodiment includes a first side 1 and a second side 2 pivotable about a pivot point 11. The case 100 is suitable for carrying a hand tool 4 and may be adapted to carry hand tool accessories (not shown). In an alternate embodiment, the case 100 does not open and the hand tool accessories are adapted to fit into receptacles on the front of the case. In yet another embodiment, the case is a disposable package for holding and displaying the hand tool 4 at a point of sale. In a further embodiment, the case 100 has a transparent first side 1, made of any suitable material, such as plastic, to allow customers to see the contents of the case.

In an embodiment, the first side 1 and second side 2 of the case 100 are selectively lockable. A sliding latch 141 on the second side 2 engages a protrusion 142 on the first side 1 to selectively hold the case 1 in a closed position. Also, the case 100 may be fixed in the closed position at the point of sale. The first side 1 and second side 2 of the case 100 have corresponding eyes 151 and 152, respectively. The eyes 151 and 152 are adapted to receive a zip-tie to hold the case 4 in the closed position.

At the point of sale, it is preferable to have one or more ways of displaying the case 100. In an embodiment, the handle 41 of the hand tool 4 has an aperture 31 having an axis perpendicular to a first side 1 of the case 100 when the opposed handle portions 21 are aligned with the handle 4. The aperture 31 allows the case 1 to be displayed on, for example a hanger on a display rack.

The retaining member 3 combines with the inside wall 2*a* of the case 100 and is adapted to receive the hand tool 4 and hold the working end 42 of the hand tool 4 in position when the case 100 is closed. In the illustrated embodiment, the retaining member 3 has a semi-circular cut-out 32 and hole 33 adapted to receive the working end 42 of the hand tool 4. The top edge 421 of the working end 42 fits underneath the bottom of edge of the semi-circular cut-out 32. When the case 100 is in the closed position, the hand tool 4 cannot be removed from the retaining member 3. When the case 100 is opened, the hand tool 4 is readily removable from the retaining member 3.

In an embodiment, the case 100 has two opposed projecting handle portions 21. The projecting handle portions 21 form part of the handle for the case 100. When the hand tool 4 is combined with the case 100, the opposed handle portions 21 and the handle 41 of the hand tool 4 form a generally continuous handle for the case 100. In an alternative embodiment, shown in FIG. 4, the projecting handle portions 21 have been removed and the handle 41 of the hand tool 4 is the sole handle for the case. In both embodiments, the handle 41 of the hand tool 4 projects from the case and is rotatable with respect to the case 100. The aforementioned designs advantageously allow the customer to test the function of the hand tool 4 by rotating its handle 41 with respect to the case 100.

In an embodiment, the handle 41 of the hand tool 4 is generally T-shaped and has an ergonomic feel to comfortably form to a customer's hand. However, any shape or variation of the handle 41 may be provided, so long as it provides a comfortable grip for the customer.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

We claim:

1. An apparatus comprising:

a case having a retaining portion; and a hand tool having a working end and a handle with a longitudinal portion perpendicular to the working end and spaced apart a fixed distance from the working end, the hand tool having a ratcheting mechanism with a working axis, wherein the working axis extends between the working end and the longitudinal portion of the handle and through the ratcheting mechanism, wherein the longitudinal portion of the handle is perpendicular to the working axis, wherein the handle projects from the case to form a handle for the case, and the case engages the hand tool such that the hand tool is prevented from being removed from the case while simultaneously, the retaining portion engages the working end of hand tool so that the handle can be rotated around the working axis and with respect to the case to test a rotational ratcheting function of the hand tool, wherein the handle remains spaced apart a fixed distance from the working end while the rotational ratcheting function of the hand tool is being tested.

2. The apparatus of claim 1, wherein the hand tool is prevented from being removed from the case and the handle can be rotated with respect to the case when the case is in a closed position.

3. The apparatus of claim 2, wherein the hand tool is allowed to be removed from the case when the case is in an open position.

4. A case for holding and displaying a ratcheting hand tool at a point of sale, the case comprising:

a front side and a back side combined together and an upper mating edge at a top of the front side and the back side with an opening therein into an area formed between the front side and the back side;

a ratcheting hand tool with a working end and a handle having a longitudinal portion perpendicular to the working end and spaced apart a fixed distance from the opening to the case, the hand tool has a ratcheting mechanism with a working axis, wherein the working axis extends between the working end and the longitudinal portion of the handle to provide selective one-way rotation of the working end, wherein the longitudinal portion of the handle is perpendicular to the working axis;

the working end of the ratcheting hand tool is positioned in the area between the front side and the back side of the case, and the handle projects from the opening with the longitudinal portion positioned above the upper mating edge a sufficient distance for a user to wrap his fingers around the longitudinal portion and the fingers remain above the upper mating edge; and a retaining portion positioned in the area between the front side and the back side and engaging the working end of hand tool so that the handle can be rotated around the working axis in one direction with respect to the case and the working end remains stationary to test a ratcheting function of the hand tool, wherein the handle remains spaced apart a fixed distance from the working end while the rotational ratcheting function of the hand tool is being tested.

5. The apparatus of claim 3, wherein the tool handle has an aperture, the aperture having an axis perpendicular to a display side of the case when the opposed handle portions and the handle are in alignment.

6. The apparatus of claim 5, wherein the case is a case.

7. The apparatus of claim 6, wherein the case is adapted to carry interchangeable driven bits.

8. The apparatus of claim 1, wherein the retaining member is combinable with an interior wall of the case and adaptable to retain the working end of the hand tool so that the handle can be rotated in one direction with respect to the case and the working end remains stationary to test a ratcheting function of the hand tool.

9. The apparatus of claim 8, wherein the handle is ergonomically shaped.

10. The apparatus of claim 9, wherein the handle is generally T-shaped.

11. The apparatus of claim 10, wherein the case has a transparent side to reveal the contents of the case.

12. The apparatus of claim 4, wherein the case comprises two opposed projecting handle portions wherein, the opposed handle portions and the handle of the hand tool are positioned relative to one another to form a generally continuous handle of the case.

13. The case of claim 4, wherein the tool handle has an aperture having an axis perpendicular to a display side of the case when the two opposed handle portions and the handle are in alignment.

14. The case of claim 4, wherein the hand tool is prevented from being removed from the case and the handle can be rotated with respect to the case when the case is in a closed position.

15. The case of claim 4, wherein the hand tool is allowed to be removed from the case when the case is in an open position.

16. The case of claim 4, and further comprising two portions positioned on sides of the case opposite of the handle of the hand tool and projecting upward from the upper mating edge.

17. The case of claim 16, wherein the two portions are handle portions.

18. The case of claim 17, wherein the two portions fit generally together with the longitudinal portion of the handle of the hand tool to form a generally continuous handle of the case.

19. The apparatus of claim 1, wherein the retaining portion engages the working end of the hand tool so that the handle can be rotated in one direction with respect to the case and the working end remains stationary with respect to the handle for the hand tool.

20. The apparatus of claim 1, wherein the case further comprises a front side and a back side and a mating edge at a top of the front side and the back side with an opening in the mating edge to an area between the front side and the back side, wherein the handle projects from the opening of the case and the longitudinal portion is positioned a sufficient distance above the mating edge for the user to wrap his fingers around the longitudinal portion of the handle and remain above the mating edge, and wherein the retaining portion is in the area and engages the working end of the hand tool.

21. The apparatus of claim 20, wherein the handle for the hand tool has an aperture, the aperture having an axis perpendicular to a display side of the case.

22. The apparatus of claim 21, wherein the case is adapted to carry a plurality of driven bits that are interchangeable in the working end of the hand tool.

23. The apparatus of claim 22, wherein the retaining member is combinable with an interior wall of the case.

24. The apparatus of claim 23, wherein the case has a transparent side to reveal the contents of the case.

25. The apparatus of claim 24, wherein the handle is generally T-shaped.

26. The apparatus of claim 25, wherein the hand tool is allowed to be removed from the case when the case is in an open position.

27. The apparatus of claim 26, wherein the case comprises two opposed projecting handle portions, wherein the opposed handle portions and the handle of the hand tool are positioned relative to one another to form a generally continuous handle for the case.

28. The apparatus of claim 27, wherein the case is a case.

29. An apparatus comprising:

a case having a back, a front, a top, and a bottom, and a retaining portion; and a hand tool having a ratcheting mechanism and a working end and a handle, the handle having a longitudinal portion perpendicular to the working end and spaced apart a fixed distance from the top of the case, wherein the ratcheting mechanism has a working axis, wherein the working axis extends between the working end and the longitudinal portion of the handle, wherein the longitudinal portion of the handle is perpendicular to the working axis, wherein the handle projects from the top of the case and perpendicular from a plane defining the front of the case to form a handle for the case, and the case engages the hand tool such that the hand tool is prevented from being removed from the case while simultaneously, the retaining portion engages the working end of hand tool so that the handle can be rotated around the working axis and with respect to the case to test a rotational ratcheting function of the hand tool, wherein the handle remains spaced apart a fixed distance from the working end while the rotational ratcheting function of the hand tool is being tested.

30. The apparatus of claim 29, wherein the handle is spaced apart a fixed distance from the working end.

31. The apparatus of claim 30, wherein the retaining portion engages the working end of the hand tool so that the handle can be rotated in one direction with respect to the case and the working end remains stationary with respect to the handle for the hand tool.

* * * * *